US011633967B2

(12) United States Patent
Yoshida

(10) Patent No.: US 11,633,967 B2
(45) Date of Patent: Apr. 25, 2023

(54) BASE MATERIAL PROCESSING APPARATUS AND BASE MATERIAL PROCESSING METHOD

(71) Applicant: SCREEN HOLDINGS CO., LTD., Kyoto (JP)

(72) Inventor: Mitsuhiro Yoshida, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 345 days.

(21) Appl. No.: 16/826,918

(22) Filed: Mar. 23, 2020

(65) Prior Publication Data

US 2020/0307279 A1 Oct. 1, 2020

(30) Foreign Application Priority Data

Mar. 29, 2019 (JP) ..... JP2019-068582

(51) Int. Cl.
*B41J 15/16* (2006.01)
*B41J 2/21* (2006.01)
(Continued)

(52) U.S. Cl.
CPC ..... *B41J 15/16* (2013.01); *B41J 2/2135* (2013.01); *B41J 15/04* (2013.01); *B41J 11/44* (2013.01)

(58) Field of Classification Search
CPC . B41J 15/16; B41J 2/2135; B41J 15/04; B41J 11/44
See application file for complete search history.

(56) References Cited

U.S. PATENT DOCUMENTS

2016/0232435 A1 8/2016 Adachi
2017/0187918 A1* 6/2017 Fukui ..... H04N 1/3878
(Continued)

FOREIGN PATENT DOCUMENTS

JP 11-202419 A 7/1999
JP 2016-146088 A 8/2016
(Continued)

OTHER PUBLICATIONS

Extended European Search Report issued in corresponding European Patent Application No. 20165132.0-1017, dated Aug. 27, 2020.
(Continued)

*Primary Examiner* — Henok D Legesse
(74) *Attorney, Agent, or Firm* — McDermott Will & Emery LLP

(57) ABSTRACT

A base material processing apparatus includes a tension detector that detects tension on a base material that is being transported, an encoder that detects the amounts of rotational drive of rollers that transport the base material, edge position detectors that detect the position of an edge of the base material in the width direction, and a transport displacement calculation part that calculates a transport displacement of the base material in the transport direction. The transport displacement calculation part includes an operation unit that has completed learning through machine learning and outputs the transport displacement on the basis of at least one of the result of detecting the tension, the result of detecting the amounts of rotational drive of the rollers, and the result of detecting the position of the edge. Accordingly, the transport displacement can be detected with high accuracy and low cost.

12 Claims, 13 Drawing Sheets

(51) Int. Cl.
*B41J 15/04* (2006.01)
*B41J 11/44* (2006.01)

(56) References Cited

U.S. PATENT DOCUMENTS

| | | | | |
|---|---|---|---|---|
| 2018/0022119 | A1 | 1/2018 | Kamigiku et al. | |
| 2018/0163342 | A1 | 6/2018 | Kitagawa et al. | |
| 2018/0272759 | A1* | 9/2018 | Shiiya | B41J 15/046 |
| 2018/0272768 | A1* | 9/2018 | Usumoto | G06T 7/13 |
| 2018/0316824 | A1 | 11/2018 | Fukui et al. | |
| 2020/0298596 | A1* | 9/2020 | Hayashi | B41J 15/16 |

FOREIGN PATENT DOCUMENTS

| | | | |
|---|---|---|---|
| JP | 2018-016412 | A | 2/2018 |
| JP | 2018-051765 | A | 4/2018 |
| JP | 2018-162161 | A | 10/2018 |
| WO | 2016/194703 | A1 | 12/2016 |

OTHER PUBLICATIONS

Japanese Notice of Reasons for Refusal issued in corresponding Japanese Patent Application No. 2019-068582, dated Oct. 4, 2022, with English translation.

* cited by examiner

BASE MATERIAL PROCESSING APPARATUS AND BASE MATERIAL PROCESSING METHOD

RELATED APPLICATIONS

This application claims the benefit of Japanese Application No. 2019-068582, filed on Mar. 29, 2019, the disclosure of which is incorporated by reference herein.

BACKGROUND OF THE INVENTION

Field of the Invention

The present invention relates to a technique for use in a base material processing apparatus that processes a long band-like base material while transporting the base material, and for calculating a displacement of the base material during transport (hereinafter, referred to as a "transport displacement of the base material) in the transport direction.

Description of the Background Art

There have conventionally been known inkjet image recording apparatuses that record a multicolor image on long band-like printing paper by ejecting ink from a plurality of recording heads while transporting the printing paper in a longitudinal direction of the paper. The image recording apparatuses eject ink of different colors from the heads. Then, single-color images formed by each color ink are superimposed on one another so that a multicolor image is recorded on a surface of the printing paper.

This type of image recording apparatuses are designed to transport printing paper at a constant speed with a plurality of rollers. However, the transport speed of the printing paper under the recording heads may differ from an ideal transport speed due to skids occurring between the printing paper and the surface of each roller or due to elongation of the printing paper caused by the ink. This may cause the ejection position of each color ink to be displaced in the transport direction on the surface of the printing paper. In view of this, for example, Japanese Patent Application Laid-Open No. 2018-162161 discloses a method for detecting an error in the transport speed or in the position of the printing paper in the transport direction for the purpose of correcting the ejection positions of the ink.

The apparatus disclosed in Japanese Patent Application Laid-Open No. 2018-162161 includes a first edge sensor 31, a second edge sensor 32, and a displacement amount calculation part 41. The first edge sensor 31 detects the position of an edge 91 of printing paper 9 in the width direction at a first detection position Pa so as to acquire a first detection result R1. The second edge sensor 32 detects the position of the edge 91 of the printing paper 9 in the width direction at a second detection position Pb so as to acquire a second detection result R2. The displacement amount calculation part 41 identifies areas where the same shape of the edge 91 of the printing paper 9 appears in the first detection result R1 and the second detection result R2, and calculates a difference in time between when the identified area has been detected at the first detection position Pa and when the identified area has been detected at the second detection position Pb. On the basis of the calculated difference in time, the displacement amount calculation part 41 also calculates an actual transport speed of the printing paper 9 from the first detection position Pa to the second detection position Pb so as to detect an error in the transport speed or in the position of the printing paper 9 in the transport direction.

However, in cases such as where the printing paper is transported at high speeds or where the edge of the printing paper has fine irregularities smaller than the interval of measurements by sensors, it is more difficult to detect the shape of the edge, and this may reduce accuracy in the detection of the transport displacement. Besides, if more precise sensors are used to detect the shape of the edge, the cost will increase.

SUMMARY OF THE INVENTION

It is an object of the present invention to provide a technique that enables highly accurate and low-cost detection of a transport displacement of a base material in the transport direction even in cases such as where printing paper is transported at high speeds or where the edge of printing paper has fine irregularities smaller than the interval of measurements by sensors.

To solve the problems described above, a first aspect of the present invention is a base material processing apparatus that includes a transport mechanism that transports a long band-like base material in a longitudinal direction of the base material along a transport path formed by a plurality of rollers, a transport displacement calculation part that calculates a transport displacement in a transport direction of the base material that is being transported, and at least one of a) a tension detector connected directly or indirectly to at least one of the plurality of rollers and that detects tension on the base material that is being transported by the plurality of rollers, b) an encoder connected directly or indirectly to at least one of the plurality of rollers and that detects an amount of rotational drive of the at least one roller; and c) an edge position detector that continuously or intermittently detects a position of an edge of the base material in a width direction at each of a first detection position and a second detection position that are spaced from each other in the transport direction in the transport path. The transport displacement calculation part includes an operation unit that has completed learning through machine learning and outputs a transport displacement of the base material in the transport direction on the basis of input of at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction.

A second aspect of the present invention is a base material processing method for calculating a transport displacement of a long band-like base material in a transport direction while transporting the base material in a longitudinal direction of the base material along a transport path formed by a plurality of rollers. The method includes at least one of a) detecting tension on the base material that is being transported by the plurality of rollers, b) detecting amounts of rotational drive of the plurality of rollers, and c) continuously or intermittently detecting a position of an edge of the base material in a width direction at each of a first detection position and a second detection position that are spaced from each other in the transport direction in the transport path, and d) calculating a transport displacement of the base material in the transport direction. Before the operation d), machine learning is performed so as to make it capable of outputting the transport displacement of the base material in the transport direction with high accuracy on the basis of input of at least one of either a result of detecting the tension on the base material in the operation a) or a result of calculating an amount of change in the tension, either a result of detecting the amounts of rotational drive of the plurality of rollers in the operation b) or a result of calculating an amount of change in the amounts of rotational drive, and a result of detecting the position of the edge of the base material in the width direction in the operation c).

A third aspect of the present invention is a base material processing apparatus that includes a transport mechanism that transports a long band-like base material in a longitudinal direction of the base material along a transport path formed by a plurality of rollers, an image recording part that ejects ink to a surface of the base material at a processing position in the transport path to record an image, a correction value calculation part that calculates a correction value for correcting an ejection timing or position of the ink and outputs the correction value to the image recording part, and at least one of a) a tension detector connected directly or indirectly to at least one of the plurality of rollers and that detects tension on the base material that is transported by the plurality of rollers, b) an encoder connected directly or indirectly to at least one of the plurality of rollers and that detects an amount of rotational drive of the at least one roller; and c) an edge position detector that continuously or intermittently detects a position of an edge of the base material in a width direction at each of a first detection position and a second detection position that are spaced from each other in the transport direction in the transport path. The correction value calculation part includes an operation unit that has completed learning through machine learning and outputs a correction value for correcting an ejection timing or position of the ink on the basis of input of at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction.

According to the first and second aspects of the present invention, the machine learning is performed in advance so as to make it capable of outputting the transport displacement of the base material in the transport direction on the basis of, for example, the result of detecting the tension on the base material. Accordingly, the transport displacement of the base material in the transport direction can be detected with high accuracy and low cost even in cases such as where the base material is transported at high speeds or where the edge of the printing paper has fine irregularities smaller than the interval of measurements by the sensors.

According to the third aspect of the present invention, the machine learning is performed in advance so as to make it capable of ejecting the ink at appropriate positions in the transport direction on the base material on the basis of, for example, the result of detecting the tension on the base material. Accordingly, the ink can be ejected at appropriate positions in the transport direction on the base material with high accuracy and low cost even in cases such as where the base material is transported at high speeds or where the edge of the printing paper has fine irregularities smaller than the interval of measurements by sensors.

These and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings. In one embodiment of the present invention, an image recording apparatus that records a multicolor image on printing paper that is being transported is given as an example of a base material processing apparatus. A description is given of an apparatus and a method for calculating a transport displacement of printing paper in the transport direction.

1. First Embodiment

1-1. Configuration of Image Recording Apparatus

Figure 1:
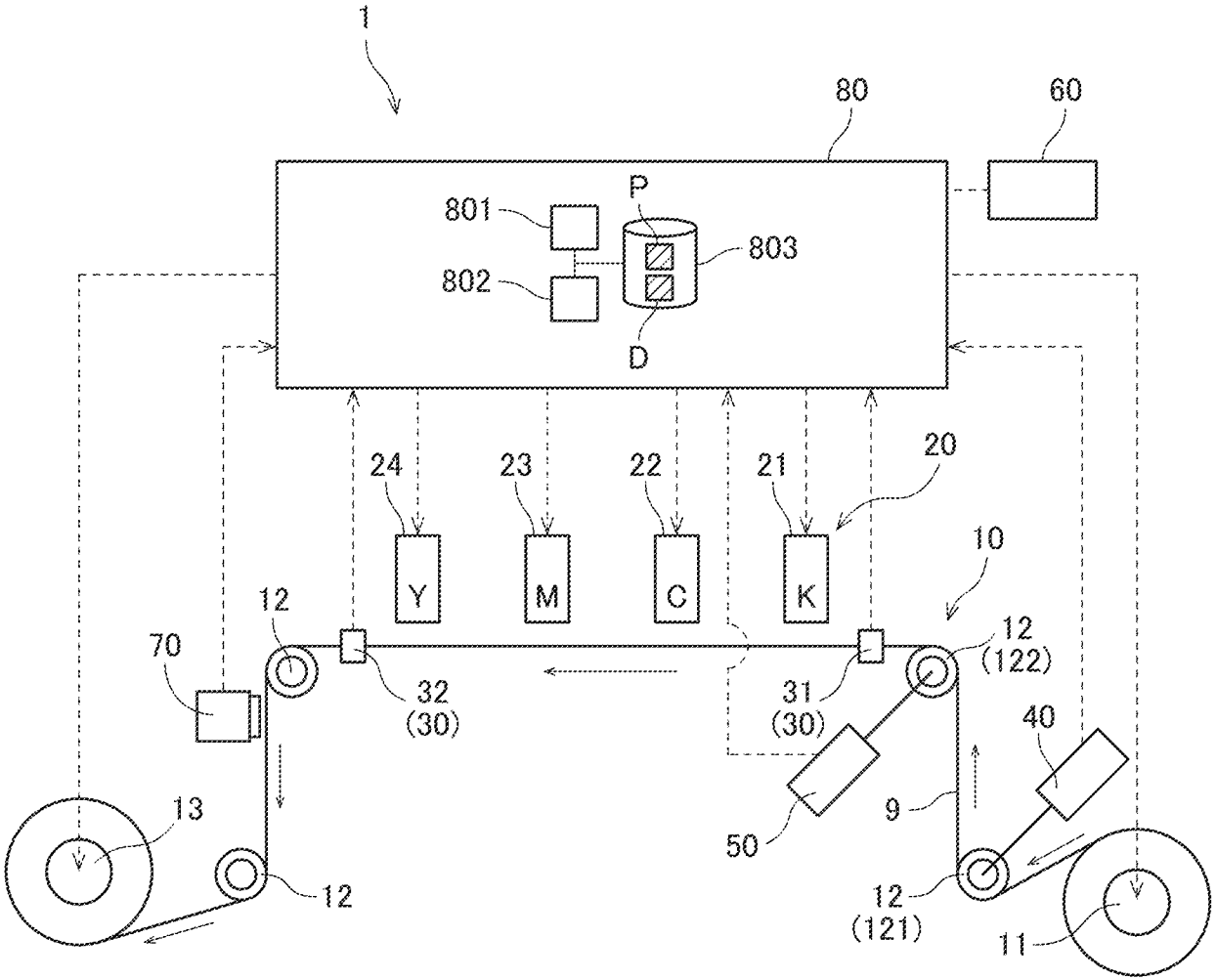
FIG. 1 illustrates a configuration of an image recording apparatus according to a first embodiment.

First, an overall configuration of an image recording apparatus 1, which is one example of the base material processing apparatus according to the present invention, will be described with reference to FIG. 1. FIG. 1 illustrates the configuration of the image recording apparatus 1. The image recording apparatus 1 is an inkjet printing apparatus that records a multicolor image on printing paper 9, which is a long band-like base material, by ejecting ink from a plurality of recording heads 21 to 24 toward the printing paper 9 while transporting the printing paper 9. As illustrated in FIG. 1, the image recording apparatus 1 includes a transport mechanism 10, an image recording part 20, two edge position detectors 30, an encoder 40, a tension detector 50, an information acquisition part 60, an image capturing part 70, and a controller 80.

The transport mechanism 10 is a mechanism for transporting the printing paper 9 in a transport direction that is along the longitudinal direction of the printing paper 9. The transport mechanism 10 according to the present embodiment includes a plurality of rollers including a feed roller 11, a plurality of transport rollers 12, and a take-up roller 13. The printing paper 9 is fed from the feed roller 11 and transported along a transport path formed by the transport rollers 12. Each transport roller 12 rotates about a horizontal axis so as to guide the printing paper 9 downstream in the transport path. The transported printing paper 9 is collected by the take-up roller 13. Note that the printing paper 9 is transported along the transport path by a later-described drive part 84 of the controller 80 rotationally driving at least one of the rollers including the feed roller 11, the transport rollers 12, and the take-up roller 13 at a predetermined rotation speed.

As illustrated in FIG. 1, the printing paper 9 travels approximately in parallel with the direction of alignment of the recording heads 21 to 24 under the recording heads 21 to 24. At this time, a record surface of the printing paper 9 faces upward. That is, the record surface of the printing paper 9 faces the recording heads 21 to 24. The printing paper 9 runs under tension over the transport rollers 12. This suppresses the occurrence of slack or creases in the printing paper 9 during transport.

The image recording part 20 is a processing part that ejects ink droplets onto the printing paper 9 that is being transported by the transport mechanism 10. The image recording part 20 according to the present embodiment includes the first recording head 21, the second recording head 22, the third recording head 23, and the fourth recording head 24. The first, second, third, and fourth recording heads 21 to 24 are aligned along the transport path of the printing paper 9.

Figure 2:
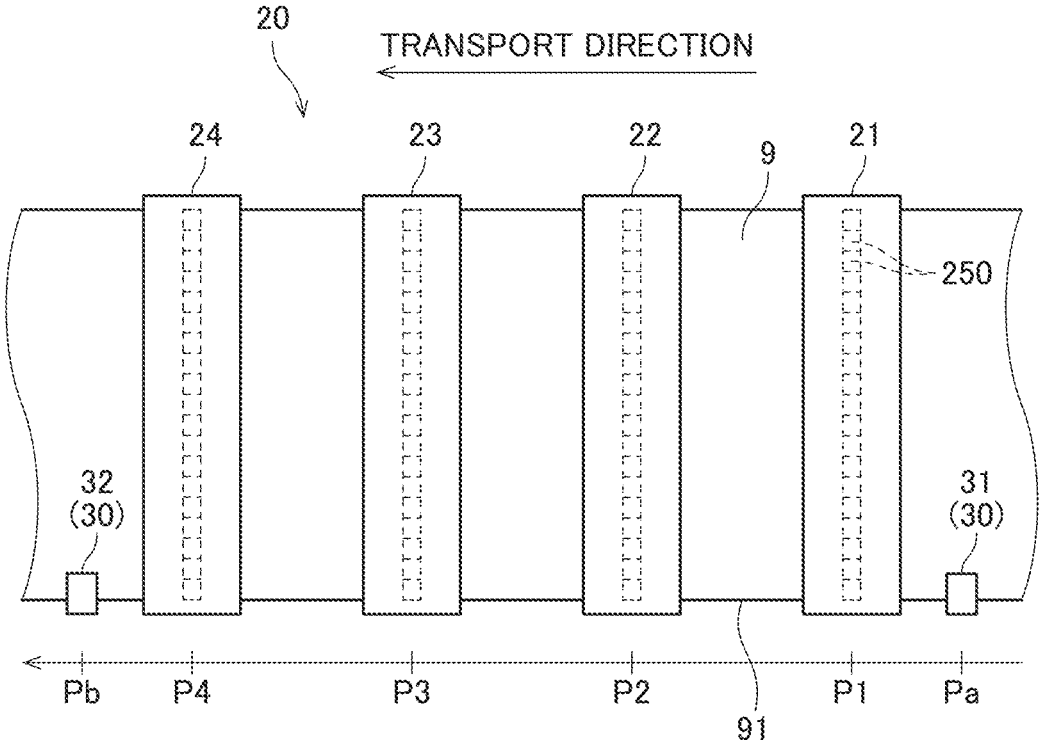
FIG. 2 is a partial top view of the image recording apparatus in the vicinity of an image recording part according to the first embodiment.

FIG. 2 is a partial top view of the image recording apparatus 1 in the vicinity of the image recording part 20. The four recording heads 21 to 24 each cover the overall dimension of the printing paper 9 in the width direction. As indicated by broken lines in FIG. 2, each of the recording heads 21 to 24 has a lower surface provided with a plurality of nozzles 250 aligned in parallel with the width direction of the printing paper 9. The recording heads 21 to 24 respectively eject K, C, M, and Y ink droplets, which are color components of a multicolor image, from the nozzles 250 toward the upper surface of the printing paper 9. Note that K, C, M, and Y respectively indicate black, cyan, magenta, and yellow.

That is, the first recording head 21 ejects K ink droplets onto the upper surface of the printing paper 9 at a first processing position P1 in the transport path. The second recording head 22 ejects C ink droplets onto the upper surface of the printing paper 9 at a second processing position P2 that is located downstream of the first processing position P1. The third recording head 23 ejects M ink droplets onto the upper surface of the printing paper 9 at a third processing position P3 that is located downstream of the second processing position P2. The fourth recording head 24 ejects Y ink droplets onto the upper surface of the printing paper 9 at a fourth processing position P4 that is located downstream of the third processing position P3. In the present embodiment, the first, second, third, and fourth processing positions P1 to P4 are aligned at equal intervals in the transport direction of the printing paper 9.

The four recording heads 21 to 24 each record a single-color image on the upper surface of the printing paper 9 by ejecting ink droplets. Then, the four single-color images are superimposed on one another so that a multicolor image is formed on the upper surface of the printing paper 9. If the ejection positions of ink droplets from the four recording heads 21 to 24 are displaced from one another in the transport direction on the printing paper 9, the image quality of printed matter will deteriorate. Thus, controlling such mutual misregistration of the single-color images on the printing paper 9 to fall within tolerance is an important factor in order to improve the print quality of the image recording apparatus 1.

Note that a dry processing part that dries the ink ejected onto the record surface of the printing paper 9 may be additionally provided downstream of the recording heads 21 to 24 in the transport direction. The dry processing part is configured to dry ink by, for example, blowing heated gas toward the printing paper 9 so as to vaporize a solvent in the ink adhering to the printing paper 9. Alternatively, the dry processing part may be configured to dry ink by other methods such as heating with heating rollers or photoirradiation.

The two edge position detectors 30 serve as detectors that detect the position of an edge 91 of the printing paper 9 in the width direction. The edge 91 refers to the edge of the printing paper 9 in the width direction. In the present embodiment, the edge position detectors 30 are disposed at a first detection position Pa located upstream of the first processing position P1 in the transport path and at a second detection position Pb located downstream of the fourth processing position P4 and spaced from the first detection position Pa on the downstream side in the transport path.

Figure 3:
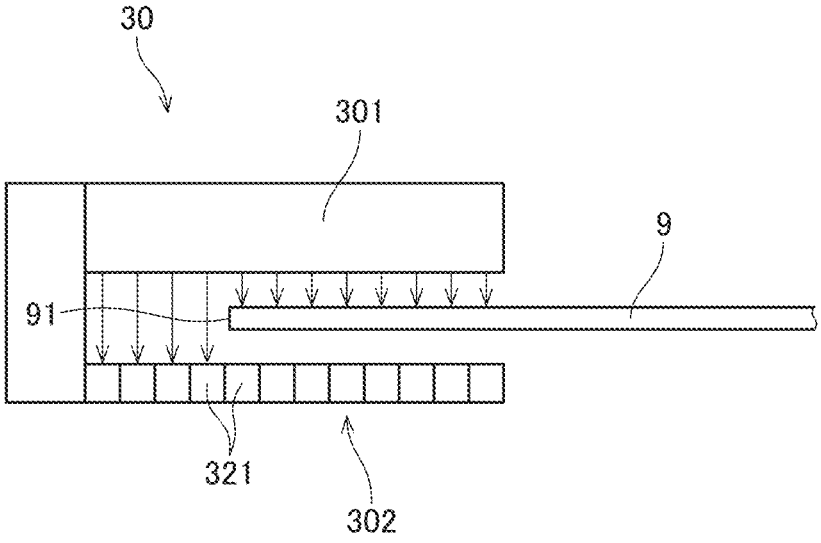
FIG. 3 schematically illustrates a structure of an edge position detector according to the first embodiment.

FIG. 3 schematically illustrates the structure of one edge position detector 30. As illustrated in FIG. 3, the edge position detector 30 includes a projector 301 located above the edge 91 of the printing paper 9, and a line sensor 302 located below the edge 91. The projector 301 emits parallel light downward. The line sensor 302 includes a plurality of light receiving elements 321 aligned in the width direction. As illustrated in FIG. 3, outside the edge 91 of the printing paper 9, the light emitted from the projector 301 enters some light receiving elements 321, and these light receiving elements 321 detect the light. On the other hand, inside the edge 91 of the printing paper 9, the light emitted from the projector 301 is blocked by the printing paper 9, and therefore light receiving elements 321 thereunder do not detect the light. The edge position detector 30 detects the position of edge 91 of the printing paper 9 in the width direction on the basis of whether the light has been detected by the plurality of light receiving elements 321.

As illustrated in FIGS. 1 and 2, the edge position detector 30 that is disposed at the first detection position Pa is hereinafter referred to as a "first edge position detector 31." The edge position detector 30 that is disposed at the second detection position Pb is referred to as a "second edge position detector 32." The first edge position detector 31 intermittently detects the position of the edge 91 of the printing paper 9 in the width direction at the first detection position Pa. Thereby, the first edge position detector 31 acquires a detection result that indicates a time-varying change in the position of the edge 91 in the width direction at the first detection position Pa. The first edge position detector 31 then outputs a detection signal indicating the acquired detection result to the controller 80. The detection signal acquired at the first detection position Pa is hereinafter referred to as a "first edge signal Ed1." The second edge position detector 32 intermittently detects the position of the edge 91 of the printing paper 9 in the width direction at the second detection position Pb. Thereby, the second edge position detector 32 acquires a detection result that indicates a time-varying change in the position of the edge 91 in the width direction at the second detection position Pb. The second edge position detector 32 then outputs a detection signal indicating the acquired detection result to the controller 80. The detection signal acquired at the second detection position Pb is hereinafter referred to as a "second edge signal Ed2." Alternatively, the first edge position detector 31 and the second edge position detector 32 each may continuously detect the position of the edge 91 of the printing paper 9 in the width direction.

Figure 4:
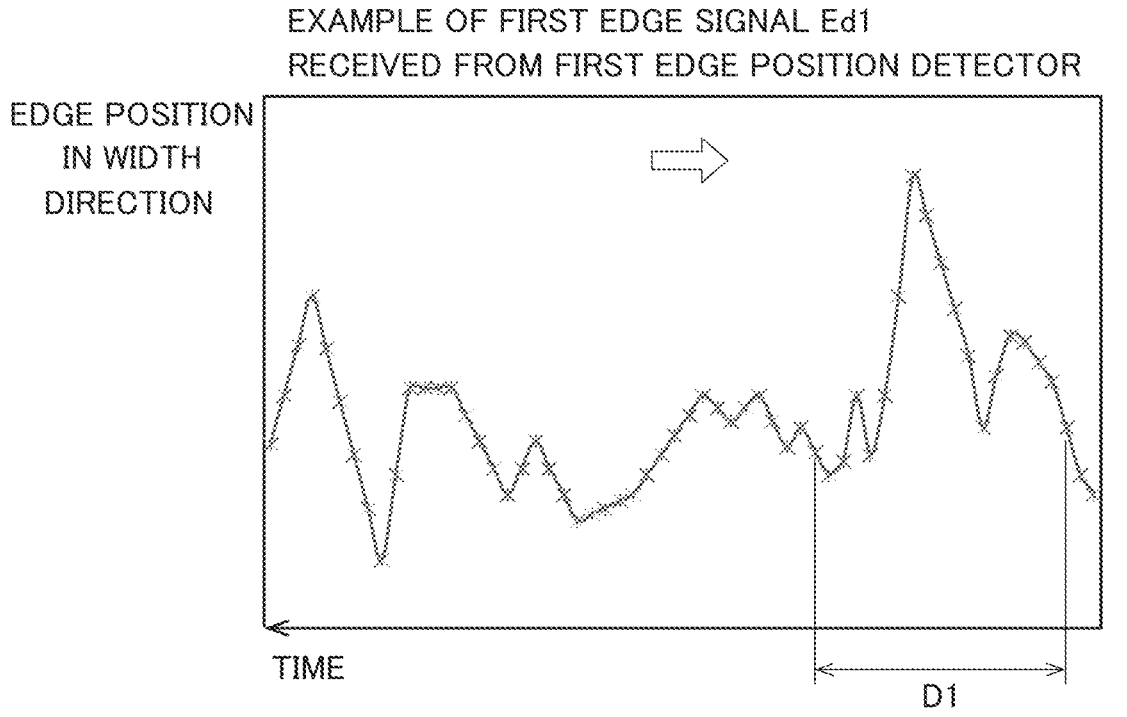
FIG. 4 is a graph showing examples of a first edge signal and a second edge signal according to the first embodiment.
Figure 4:
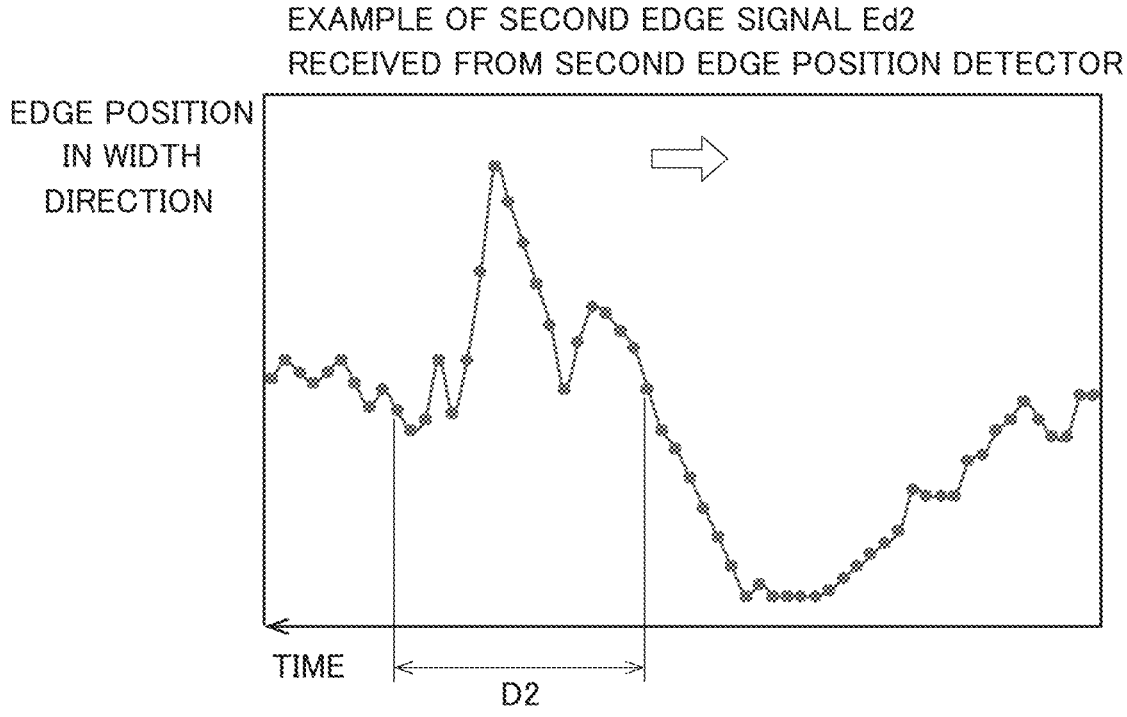

FIG. 4 illustrate graphs showing an example of the first edge signal Ed1 and an example of the second edge signal Ed2. In the graphs in FIG. 4 and FIGS. 5, 6, 10, and 11 described later, the horizontal axis indicates time. As a variation, the horizontal axis may be the distance in the transport direction on the printing paper 9. The vertical axis in FIG. 4 indicates the position of the edge 91 in the width direction. Note that the left ends of the horizontal axes in the graphs in FIG. 4 and FIGS. 5, 6, 10, and 11 described later represents current time, and the time gets earlier as the distance from the right side decreases. Thus, data lines in FIG. 4 and FIGS. 5, 6, 10, and 11 described later move toward the right with the passage of time as indicated by hollow arrows. The edge 91 of the printing paper 9 has fine irregularities. The first edge position detector 31 and the second edge position detector 32 detect the position of the edge 91 of the printing paper 9 in the width direction at pre-set very short time intervals. The very short time intervals are, for example, the intervals of 50 microseconds. Accordingly, data that indicates a time-varying change in the position of the edge 91 of the printing paper 9 in the width direction is obtained as illustrated in FIG. 4. The first edge signal Ed1 corresponds to data that reflects the shape of the edge 91 of the printing paper 9 passing through the first detection position Pa. The second edge signal Ed2 corresponds to data that reflects the shape of the edge 91 of the printing paper 9 passing through the second detection position Pb.

Figure 5:
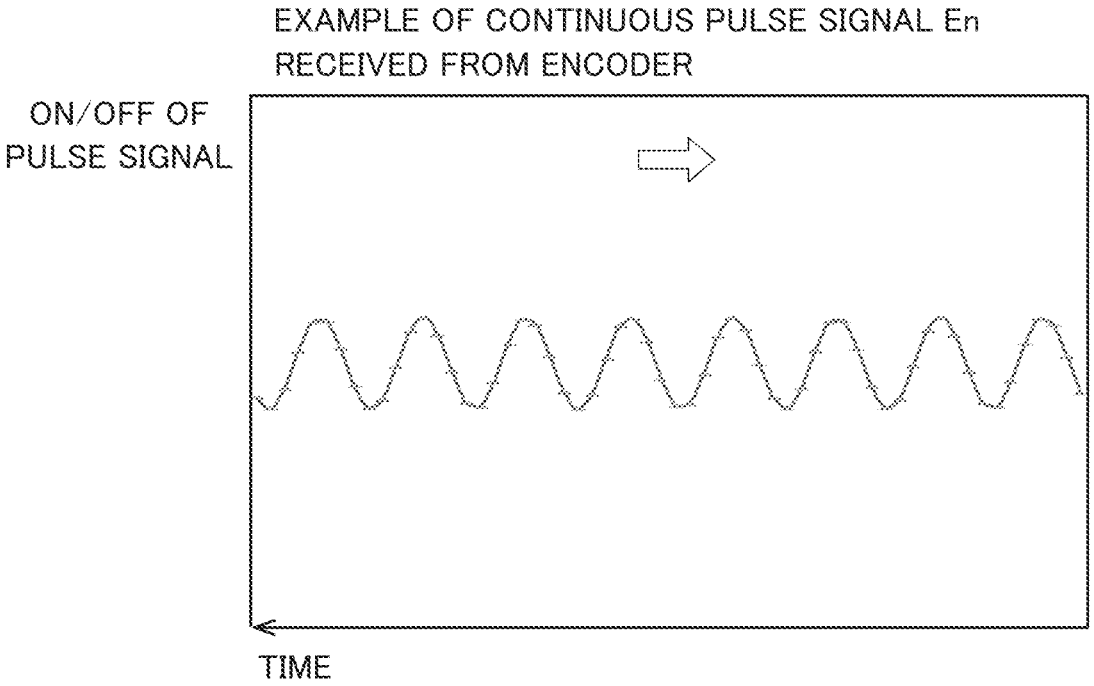
FIG. 5 is a graph showing an example of a continuous pulse signal according to the first embodiment.

The encoder 40 is mounted on the shaft of one of the transport rollers 12. In the present embodiment, the encoder 40 is mounted on the shaft of a transport roller 121 in FIG. 1. The encoder 40 detects the amount of rotational drive of the transport roller 121 and outputs a continuous pulse signal En that synchronizes with the rotation of the transport roller 121 to the controller 80. FIG. 5 is a graph showing an example of the continuous pulse signal En obtained from the encoder 40. The vertical axis in FIG. 5 indicates ON/OFF of the continuous pulse signal En. The continuous pulse signal En corresponds to data that reflects a time-varying change in the transport speed of the printing paper 9 transported by the transport rollers 12 including the transport roller 121. Note that the encoder 40 needs only to be connected directly or indirectly to at least one of the transport rollers 12, and the roller to which the encoder 40 is connected is not limited to the transport roller 121.

Figure 6:
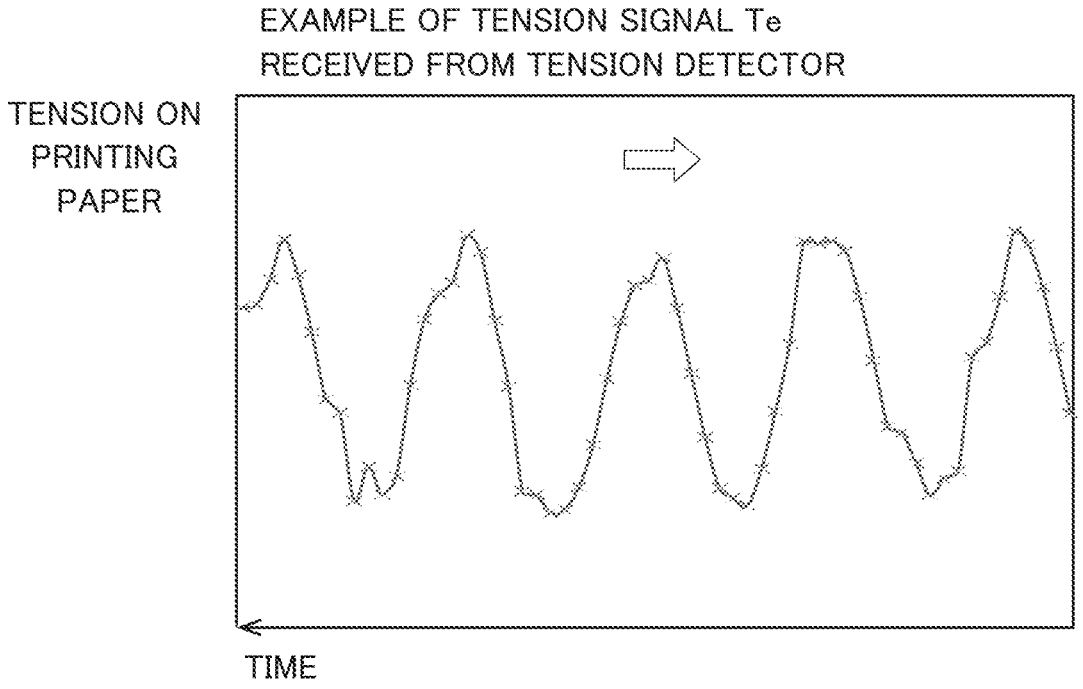
FIG. 6 is a graph showing an example of a tension signal according to the first embodiment.

The tension detector 50 is mounted on one of the transport rollers 12. In the present embodiment, the tension detector 50 is mounted on a transport roller 122 in FIG. 1. The tension detector 50 measures a force received from the printing paper 9 at the transport roller 122. The tension detector 50 thereby detects tension on the printing paper 9 and outputs a tension signal Te indicating the detection result. to the controller 80 FIG. 6 is a graph showing an example of the tension signal Te obtained from the tension detector 50. The vertical axis in FIG. 6 indicates the tension on the printing paper 9. The tension signal Te corresponds to data that reflects a time-varying change in the tension on the printing paper 9 transported by the transport rollers 12 including the transport roller 122 while remaining in contact with the transport roller 122. Note that the tension detector 50 needs only to be connected directly or indirectly to at least one of the transport rollers 12, and the roller to which the tension detector 50 is connected is not limited to the transport roller 122.

The information acquisition part 60 is a device that acquires information relating to various settings and conditions in the image recording apparatus 1. For example, the information acquisition part 60 includes an input interface such as a touch panel. An operator or other person inputs, via the input interface, information relating to, for example, the type or amount of the ink ejected from the recording heads 21 to 24 of the image recording part 20, environmental conditions including the temperature or humidity around the printing paper 9, and the type, shape, or thickness of the printing paper 9. This information is hereinafter referred to as "information Sc." The information acquisition part 60 acquires the information Sc through the input. Alternatively, the information acquisition part 60 may directly acquire the information Sc via its sensors or other devices. The information acquisition part 60 needs only to acquire at least one piece of the aforementioned information relating to various settings and conditions. Moreover, the information acquisition part 60 may acquire information other than the aforementioned information relating to various settings and conditions.

The image capturing part 70 is located downstream of the image recording part 20 in the transport path. The image capturing part 70 generates image data Di of the printing paper 9 by capturing images of the surface of the printing paper 9 on which ink is ejected from the recording heads 21 to 24 of the image recording part 20. The image capturing part 70 also outputs the generated image data Di of the printing paper 9 to the controller 80. The image capturing part 70 is a facility that has already been introduced in many cases in the image recording apparatus 1, and therefore can be used without a new introduction cost.

The controller 80 controls the operation of each part in the image recording apparatus 1. As schematically illustrated in FIG. 1, the controller 80 is configured by a computer that includes a processor 801 such as a CPU, a memory 802 such as a RAM, and a storage 803 such as a hard disk drive. The storage 803 stores a computer program P and data D for executing print processing and calculating a transport displacement of the printing paper 9, which will be described later. As indicated by broken lines in FIG. 1, the controller 80 is connected via receivers and transmitters to each of the aforementioned parts including the transport mechanism 10, the four recording heads 21 to 24, the two edge position detectors 30, the encoder 40, the tension detector 50, the information acquisition part 60, and the image capturing part 70 so as to become capable of wired communication such as Ethernet (registered trademark) or wireless communication such as Bluetooth (registered trademark) or Wi-Fi (registered trademark).

Upon receiving a signal via the receivers from the part in the image recording apparatus 1, the controller 80 controls the operation of that part by temporarily reading out the computer program P and the data D stored in the storage 803 into the memory 802 and causing the processor 801 to perform arithmetic processing on the basis of the computer program P and the data D. In this way, print processing and processing for calculating a transport displacement of the printing paper 9 in the transport direction, which will be described later, proceed in the image recording apparatus 1. In the present embodiment, the image capturing part 70 is used only in later-described learning processing that is a pre-stage of the print processing.

1-2. Data Processing in Controller

Figure 7:
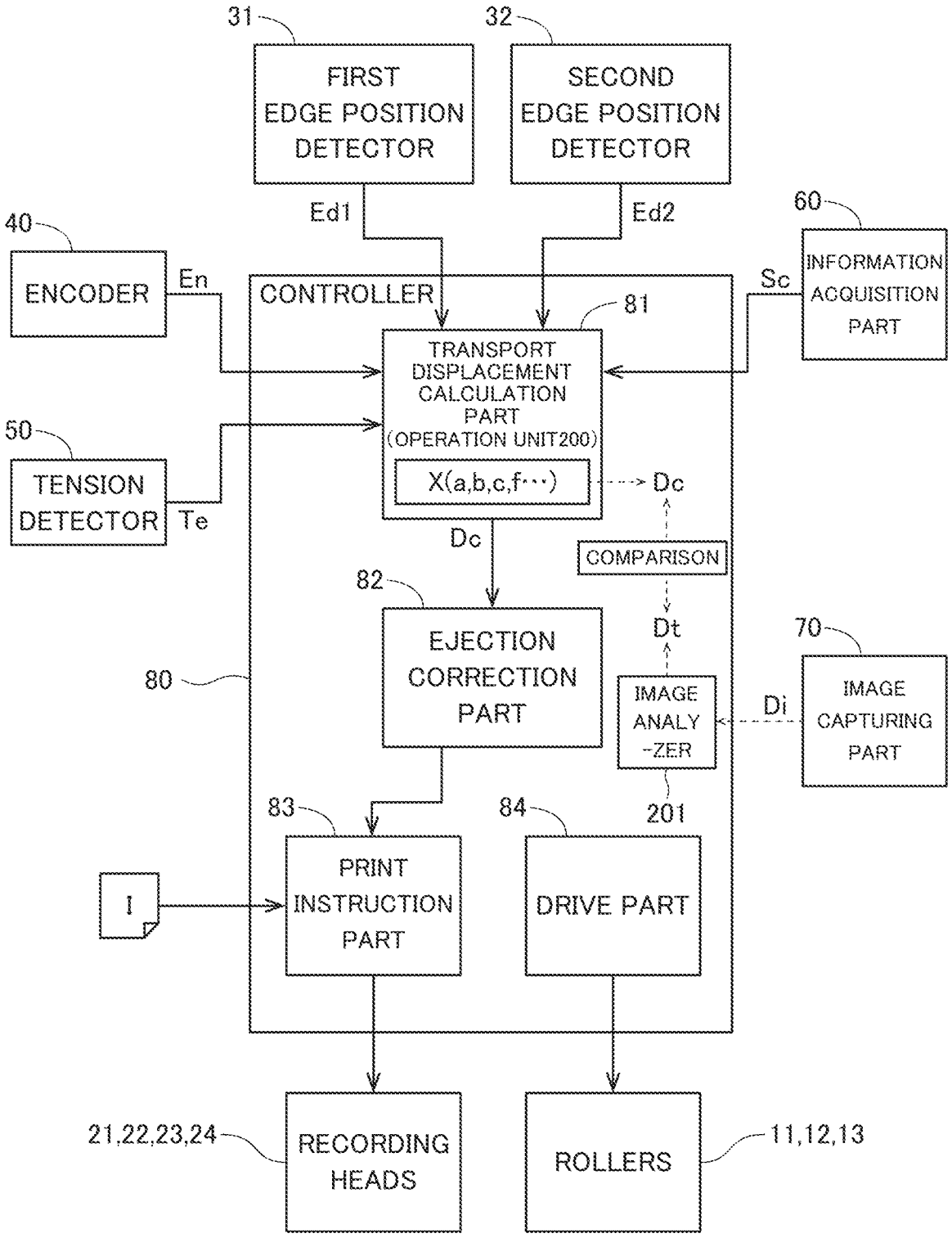
FIG. 7 is a block diagram schematically illustrating some functions implemented in a controller according to the first embodiment.

FIG. 7 is a block diagram schematically illustrating some functions implemented in the controller 80 of the image recording apparatus 1. As illustrated in FIG. 7, the controller 80 according to the present embodiment includes a transport displacement calculation part 81, an ejection correction part 82, a print instruction part 83, the drive part 84, and an image analyzer 201. These functions are implemented by the computer temporarily reading out the computer program P and the data D stored in the storage 803 into the memory 802 and causing the processor 801 to perform arithmetic processing on the basis of the computer program P and the data D. The function of the transport displacement calculation part 81 is implemented by an operation unit 200 that include some or all mechanical elements of the controller 80. The operation unit 200 stores a learned learning model generated through machine learning.

First, configurations of the operation unit 200 and the image analyzer 201 and the process of generating the learning model stored in the operation unit 200 through machine learning will be described. The operation unit 200 is a device that calculates and outputs a transport displacement in the transport direction of the printing paper 9 that is being transported, on the basis of various pieces of input information. The image analyzer 201 is a function of calculating an actual transport displacement of the printing paper 9 in the transport direction through image analysis on the basis of the image data Di of the printing paper 9 that is input from the aforementioned image capturing part 70.

Figure 8:
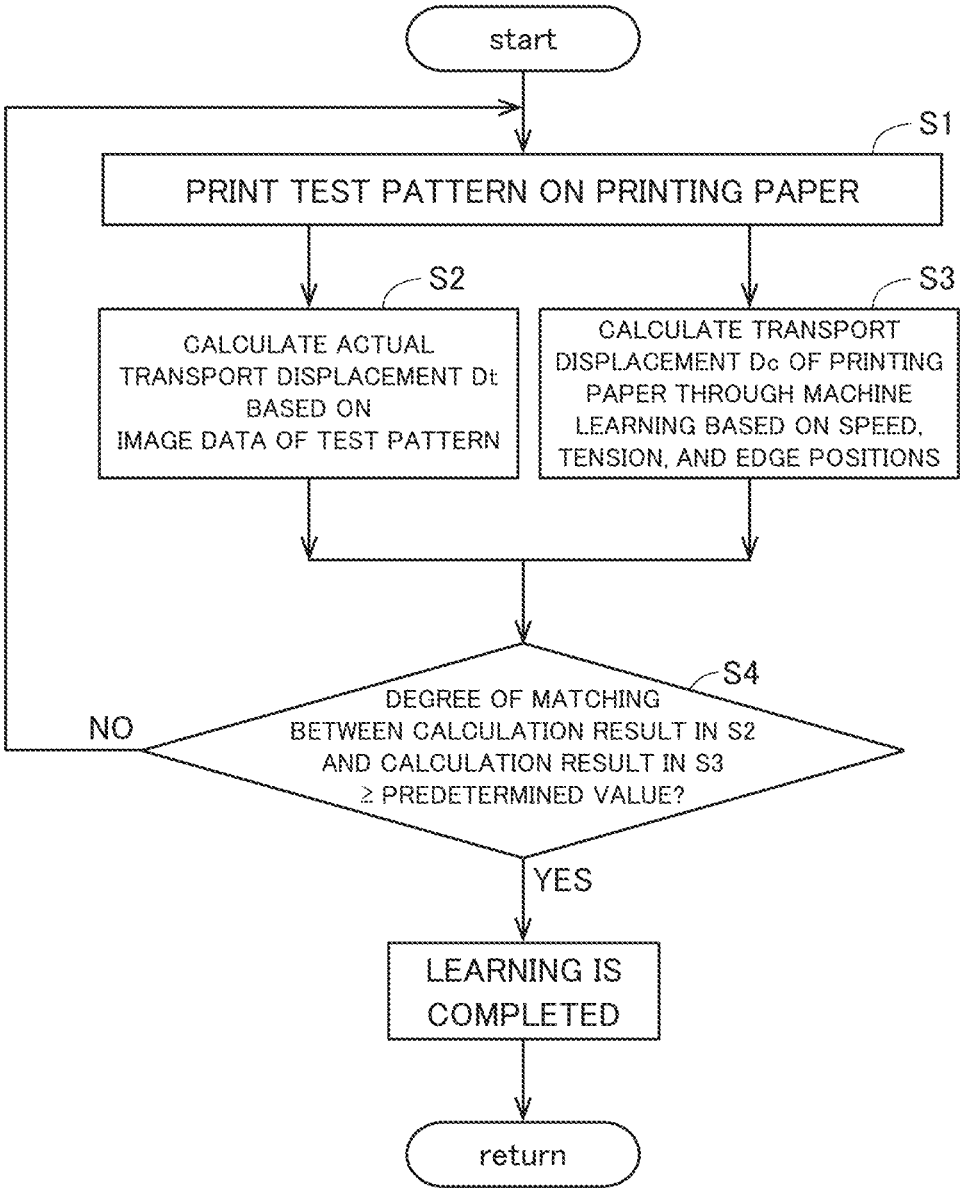
FIG. 8 is a flowchart illustrating a procedure of learning processing according to the first embodiment.

The procedure of learning is schematically illustrated by broken lines in FIG. 7 and in the flowchart in FIG. 8. When learning is performed, in the image recording apparatus 1, a test pattern is printed on the surface of the printing paper 9 by practically ejecting ink from the recording heads 21 to 24 toward the printing paper 9 while transporting the printing paper 9 (step S1). The test pattern as used herein refers to, for example, a plurality of lines or marks that are printed spaced from one another in the transport direction.

At this time, the image capturing part 70 captures, a plurality of times, an image of the surface of the printing paper 9 on which the test pattern has been printed, so as to generate the image data Di as described above. A plurality of pieces of image data Di is prepared as the image data for learning. For example, approximately 10 to 1000 pieces of image data are prepared for learning. These pieces of image data Di are input to the image analyzer 201. The image analyzer 201 analyzes each piece of image data Di and calculates an actual transport displacement Dt of the printing paper 9 in the transport direction for each piece of image data Di (step S2). Alternatively, the actual transport displacement Dt of the printing paper 9 in the transport direction may be calculated through a visual check by the operator or other person.

Meanwhile, when the test pattern is printed on the printing paper 9, the encoder 40 detects a time-varying change in the amount of rotational drive of the transport roller 121 and inputs the continuous pulse signal En relating to the detection result to the operation unit 200. The tension detector 50 detects a time-varying change in the tension on the printing paper 9 that is in contact with the transport roller 122 and inputs the tension signal Te relating to the detection result to the operation unit 200. The first edge position detector 31 and the second edge position detector 32 intermittently detect the positions in the width direction of the edge 91 of the printing paper 9 passing through the first detection position Pa and the second detection position Pb and input the first edge signal Ed1 and the second edge signal Ed2 relating to the detection results to the operation unit 200. As a pre-stage before the test pattern is printed on the printing paper 9, the information acquisition part 60 inputs to the operation unit 200 the information Sc relating to, for example, the type or amount of ink used for printing of the printing paper 9, environmental conditions including the temperature or humidity around the printing paper 9, and the type, shape, or thickness of the printing paper 9.

Then, the operation unit 200 performs learning processing through machine learning so as to make it capable of highly accurately calculating the transport displacement Dc in the transport direction of the printing paper 9 transported by the transport mechanism 10 on the basis of the input continuous pulse signal En, the input tension signal Te, the input first and second edge signals Ed1 and Ed2, and the input information Sc (step S3). Specifically, the operation unit 200 uses the actual transport displacement Dt of the printing paper 9 in the transport direction, calculated by the image analyzer 201, as teacher data (correct data) and performs machine learning of a learning model X (a, b, c, f (En, Te, Ed1, Ed2), . . . ) for calculating the aforementioned transport displacement Dc of the printing paper 9 in the transport direction with high accuracy. Alternatively, instead of inputting the continuous pulse signal En indicating a time-varying change in the amount of rotational drive of the transport roller 121, the operation unit 200 may calculate a time-varying change in the amount of rotational drive of the transport roller 121 and use the calculation result in the machine learning. As another alternative, instead of inputting the tension signal Te indicating a time-varying change in the tension on the printing paper 9, the operation unit 200 may calculate a time-varying change in the tension on the printing paper 9 and use the calculation result in the machine learning.

Figure 9:
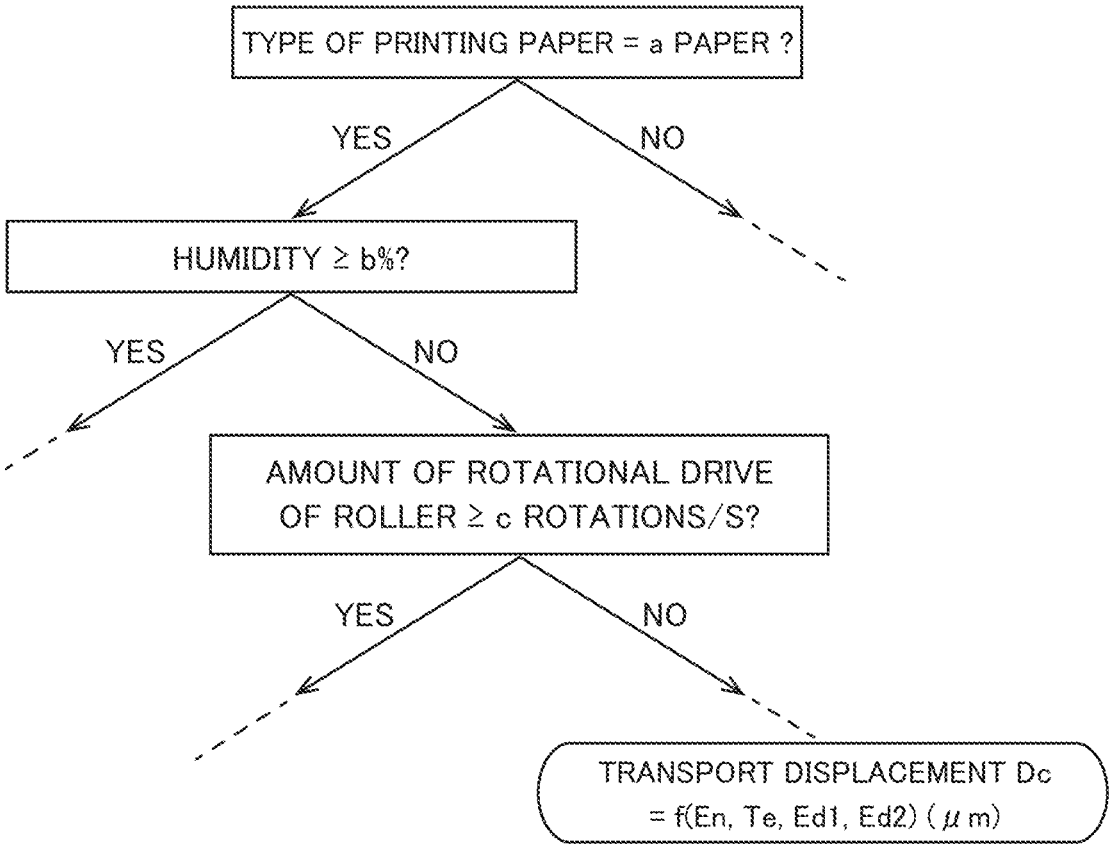
FIG. 9 illustrates an example of a decision tree included in an operation unit according to the first embodiment.

Note that the learning model X (a, b, c, f (En, Te, Ed1, Ed2), . . . ) stored in the operation unit 200 according to the present embodiment is a decision tree. FIG. 9 illustrates an example of the decision tree according to the present embodiment. In the machine learning, the operation unit 200 adjusts, updates, and stores a plurality of parameters (a, b, c, f (En, Te, Ed1, Ed2), . . . ) included in the decision tree so as to minimize a difference between the actual transport displacement Dt of the printing paper 9 in the transport direction calculated by the image analyzer 201 and the transport displacement Dc of the printing paper 9 in the transport direction calculated on the basis of the input continuous pulse signal En, the input tension signal Te, the input first and second edge signals Ed1 and Ed2, and the input information Sc. When a single test pattern is printed, the operation unit 200 may perform learning once, or may perform learning a plurality of times. For example, the operation unit 200 may generate a plurality of decision trees that are learning models X (a, b, c, f (En, Te, Ed1, Ed2), . . . ) through machine learning. For example, the operation unit 200 may generate a decision tree for each type of printing paper 9. Note that an algorithm using a gradient descent method such as LightGBM may be used as a learning algorithm for generating a decision tree.

The method of performing machine learning for the processing for highly accurately calculating the transport displacement Dc of the printing paper 9 in the transport direction is, however, not limited to this example. For example, the operation unit 200 may use a convolution neural network to repeatedly execute encoding processing and decoding processing, the encoding processing being processing for extracting features from the input continuous pulse signal En, the input tension signal Te, the input first and second edge signals Ed1 and Ed2, and the input information Sc to generate latent variables, and the decoding processing being processing for calculating the transport displacement Dc of the printing paper 9 in the transport direction from the latent variables. Then, the operation unit 200 may adjust, update, and store parameters used in the encoding processing and the decoding processing by a back propagation method so as to minimize the difference between the transport displacement Dc after the decoding processing and the actual transport displacement Dt of the printing paper 9 in the transport direction calculated by the image analyzer 201.

Figure 10:
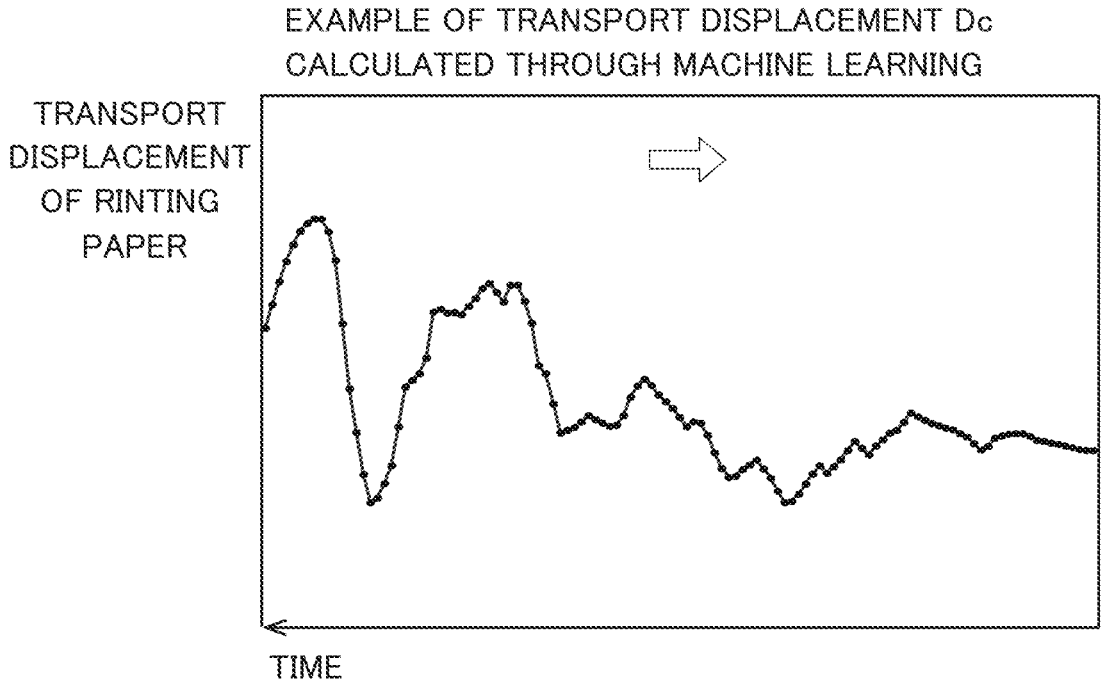
FIG. 10 is a graph showing an example of a transport displacement of printing paper in the transport direction, calculated through machine learning according to the first embodiment.

If the degree of matching between the transport displacement Dc of the printing paper 9 in the transport direction calculated by the operation unit 200 and the actual transport displacement Dt of the printing paper 9 in the transport direction calculated by the image analyzer 201 is greater than or equal to a predetermined value (step S4), the machine learning is completed. Accordingly, the image recording apparatus 1 becomes capable of calculating the transport displacement Dc of the printing paper 9 in the transport direction with high accuracy, with use of the learned learning model X (a, b, c, f (En, Te, Ed1, Ed2), . . . ). FIG. 10 is a graph showing an example of the transport displacement Dc of the printing paper 9 in the transport direction calculated through the machine learning performed by the operation unit 200. As illustrated in FIG. 10, the operation unit 200 is capable of using the continuous pulse signal En obtained by the conventional encoder 40, the tension signal Te obtained by the conventional tension detector 50, and the first and second edge signals Ed1 and Ed2 obtained by the conventional first and second edge position detectors 31 and 32 to calculate the transport displacement Dc at low cost and with more minute accuracy than the interval of measurements of these signals. The operation unit 200 is also capable of detecting the transport displacement Dc of the printing paper 9 in the transport direction with high accuracy even in cases such as where the printing paper 9 is transported at high speeds or where the edge of the printing paper 9 has fine irregularities smaller than the interval of measurements of the first and second edge signals Ed1 and Ed2.

When the machine learning has been completed as described above, the learning model X (a, b, c, f (En, Te, Ed1, Ed2), . . . ) continues to be used in subsequent print processing while remaining stored in the controller 80 including the operation unit 200. Alternatively, the learning model X (a, b, c, f (En, Te, Ed1, Ed2), . . . ) may be generated in advance through machine learning performed outside the image recording apparatus 1, and then the learned learning model X (a, b, c, f (En, Te, Ed1, Ed2), . . . ) may be installed in the operation unit 200 in the image recording apparatus 1 and used in subsequent print processing.

Referring back to FIG. 7, when print processing is performed, the controller 80 causes the operation unit 200 of the transport displacement calculation part 81 to calculate the transport displacement Dc of the printing paper 9 in the transport direction by using the learned learning model X (a, b, c, f (En, Te, Ed1, Ed2), . . . ) and the aforementioned signals such as the continuous pulse signal En obtained by the encoder 40.

On the basis of the calculated transport displacement Dc, the ejection correction part 82 calculates a correction value for correcting the ejection timing of ink droplets from each of the recording heads 21 to 24, and outputs the correction value to the print instruction part 83. For example, in the case where the time at which an image recording portion of the printing paper 9 arrives at each of the processing positions P1 to P4 lags behind the ideal time (transport displacement Dc increases in the plus direction), the ejection correction part 82 delays the ejection timing of ink droplets from each of the recording heads 21 to 24. In the case where the time at which the image recording portion of the printing paper 9 arrives at each of the processing positions P1 to P4 is earlier than the ideal time (transport displacement Dc increases in the minus direction), the ejection correction part 82 advances the ejection timing of ink droplets from each of the recording heads 21 to 24.

The print instruction part 83 controls the operation of ejecting ink droplets from each of the recording heads 21 to 24 on the basis of received image data I. At this time, the print instruction part 83 references the correction value for correcting the ejection timing, which is output from the ejection correction part 82. Then, the print instruction part 82 shifts the original ejection timing based on the image data I in accordance with the correction value. This allows ink droplets of each color to be ejected at appropriate positions in the transport direction on the printing paper 9 at each of the processing positions P1 to P4. Accordingly, it is possible to suppress mutual misregistration of the single-color images formed by each color ink. As a result, a high-quality print image can be obtained.

2. Variations

While a primary embodiment of the present invention has been described thus far, the present invention is not limited to the above-described embodiment.

Figure 11:
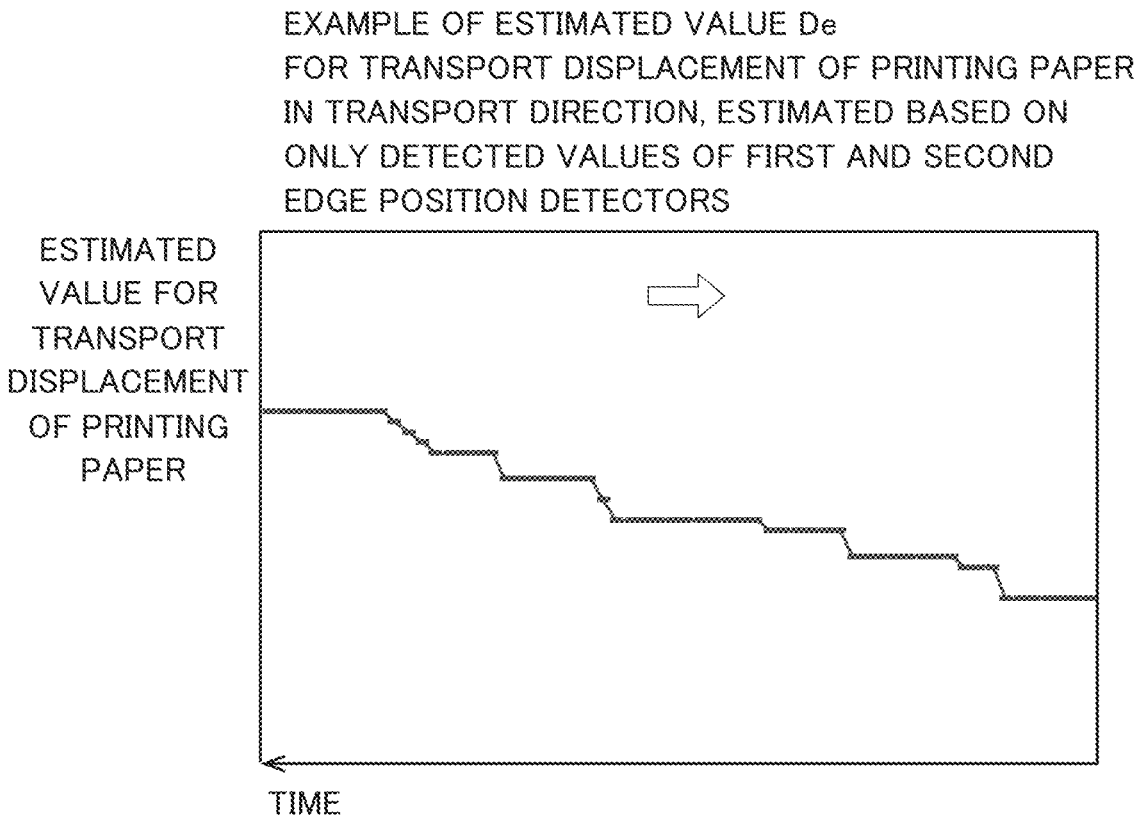
FIG. 11 is a graph showing an example of an estimated value for the transport displacement of printing paper in the transport direction, estimated by using only an edge position detector according to a variation.

In the above-described embodiment, the first edge signal Ed1 and the second edge signal Ed2 obtained by the first edge position detector 31 and the second edge position detector 32 are independently input to the operation unit 200. Also, the operation unit 200 uses the first edge signal Ed1 and the second edge signal Ed2 independently to perform machine learning for calculating the transport displacement Dc of the printing paper 9 in the transport direction. However, the transport displacement of the printing paper 9 in the transport direction may be first estimated to a certain degree on the basis of only the first edge signal Ed1 and the second edge signal Ed2. Then, the operation unit 200 may use this estimated value De to perform machine learning for calculating the transport displacement Dc of the printing paper 9 in the transport direction. FIG. 11 is a graph showing an example of the estimated value De.

Hereinafter, a method of estimation is described. Referring back to FIG. 4, first, the transport displacement calculation part 81 compares the first edge signal Ed1 and the second edge signal Ed2. Then, the transport displacement calculation part 81 identifies areas where the same shape of the edge of the printing paper 9 appears in the first edge signal Ed1 and the second edge signal Ed2. Specifically, for each data section (a given range of time) included in the first edge signal Ed1, the transport displacement calculation part 81 identifies a highly matched data section included in the second edge signal Ed2. In the following description, the data sections included in the first edge signal Ed1 are referred to as "comparison-source data sections D1." The data sections included in the second edge signal Ed2 are referred to as "to-be-compared data sections D2."

For the identification of data sections, a matching technique such as cross-correlation or residual sum of squares is used, for example. For each comparison-source data section D1 included in the first edge signal Ed1, the transport displacement calculation part 81 selects a plurality of to-be-compared data sections D2 included in the second edge signal Ed2 as candidates for the corresponding data section. The transport displacement calculating part 81 also calculates an evaluation value that indicates the degree of matching with the comparison-source data section D1 for each of the selected to-be-compared data sections D2. Then, the transport displacement calculation part 81 identifies the to-be-compared data section D2 with a highest evaluation value as the to-be-compared data section D2 corresponding to the comparison-source data section D1.

Note that the time difference between the first edge signal Ed1 and the second edge signal Ed2 does not considerably differ from the ideal transport time of the printing paper 9 from the first detection position Pa to the second detection position Pb. Thus, the aforementioned search for the to-be-compared data section D2 may be conducted at only around the time after the elapse of the ideal transport time from the comparison-source data section D1. Once the to-be-compared data section D2 corresponding to the comparison-source data section D1 has been identified, the next and subsequent searches may be conducted only in the vicinity of data sections that are adjacent to the searched to-be-compared data sections D2.

In this way, the transport displacement calculation part 81 may estimate a to-be-compared data section D2 in the second edge signal Ed2 that corresponds to the comparison-source data section D1 in the first edge signal Ed1 and conduct a search only in the vicinity of the estimated data section for the to-be-compared data section D2 that is highly matched with the comparison-source data section D1. This narrows the range of search for the to-be-compared data sections D2. Accordingly, it is possible to reduce arithmetic processing loads on the transport displacement calculation part 81.

Thereafter, the transport displacement calculation part 81 calculates an actual transport time of the printing paper 9 from the first detection position Pa to the second detection position Pb on the basis of a time difference between the detection time of the comparison-source data section D1 and the detection time of the corresponding to-be-compared data section D2. On the basis of the calculated transport time, the transport displacement calculation part 81 also calculates an actual transport speed of the printing paper 9 under the image recording part 20. Then, on the basis of the calculated transport speed, the transport displacement calculating part 81 calculates times when each portion of the printing paper 9 arrives at the first processing position P1, the second processing position P2, the third processing position P3, and the fourth processing position P4. Accordingly, the estimated value De is calculated for the transport displacement of each portion of the printing paper 9 in the transport direction when the printing paper 9 is transported at the ideal transport time. At each of the plurality of locations including the first processing position P1, the second processing position P2, the third processing position P3, and the fourth processing position P4, the estimated value De for the transport displacement is calculated by multiplying the difference between the actual arrival time and an assumed arrival time when the printing paper 9 is transported at the ideal transport speed, by the actual transport speed.

In the above-described embodiment, the ejection correction part 82 calculates the correction value for corresponding the ejection timing of ink droplets from each of the recording heads 21 to 24, on the basis of the transport displacement Dc of the printing paper 9 in the transport direction. However, instead of correcting the ejection timing of ink droplets, the controller 80 may include a tension correction part that corrects drive of the take-up roller 13. In this case, the tension applied in the transport direction on the printing paper 9 may be corrected. Specifically, first, the tension correction part calculates the amount of elongation of the printing paper 9 in the transport direction on the basis of the transport displacement Dc of the printing paper 9 in the transport direction. If the calculated amount of elongation is greater than a reference value, for example the tension correction part reduces the number of rotations in a direction in which the take-up roller 13 takes up the printing paper 9. This weakens the tension on the printing paper 9 and reduces the amount of elongation. If the amount of elongation is less than the reference value, for example the tension correction part increases the number of rotations in the direction in which the take-up roller 13 takes up the printing paper 9. This increases the tension on the printing paper 9 and increases the amount of elongation. As a result, misregistration in the transport direction of single-color images formed by each color ink is suppressed.

In the above-described first embodiment, the ejection correction part 82 calculates the correction value for correcting the ejection timing of ink droplets from each of the recording heads 21 to 24 without correcting the input image data I itself. However, the ejection correction part 82 may calculate a correction value for correcting the image data I itself on the basis of the transport displacement Dc calculated by the operation unit 200. In this case, the print instruction part 83 may cause each of the recording heads 21 to 24 to eject ink in accordance with the corrected image data I. The ejection correction part 82 may also calculate a correction value for correcting the ejection position of ink from each of the recording heads 21 to 24 on the basis of the transport displacement Dc calculated by the operation unit 200. That is, the ejection correction part 82 needs only to calculate a correction value for correcting either the ejection timing or position of ink droplets from the image recording part 20.

In FIG. 2 described above, the recording heads 21 to 24 each have the nozzles 250 aligned in the width direction. However, each of the recording heads 21 to 24 may have nozzles 250 arranged in two or more lines.

In the above-described embodiment, transmission edge sensors are used as the first edge position detector 31 and the second edge position detector 32. However, other detection methods may be used in the first edge position detector 31 and the second edge position detector 32. For example, reflection optical sensors or CCD cameras may be used. The first edge position detector 31 and the second edge position detector 32 may be configured to detect the position of the edge 91 of the printing paper 9 two-dimensionally in the transport direction and the width direction. The first edge position detector 31 and the second edge position detector 32 may perform detection operations intermittently as in the above-described embodiment, or may perform detection operations continuously.

In the above-described embodiment, the image recording apparatus 1 includes the four recording heads 21 to 24. However, the number of recording heads in the image recording apparatus 1 may be in the range of one to three, or five or more. For example, the image recording apparatus 1 may include another recording head that ejects ink of a special color, in addition to the recording heads that eject ink of K, C, M, and Y colors.

The image recording apparatus 1 may include at least one of the two edge position detectors 30, the encoder 40, and the tension detector 50. Then, the operation unit 200 may receive input of the information Sc obtained by the information acquisition part 60 and at least one of either the result of the tension detector 50 detecting the tension on the printing paper 9 that is being transported or the result of calculating the amount of change in the tension, either the result of the encoder 40 detecting the amounts of rotational drive of the transport rollers 12 or the result of calculating the amount of change in the amounts of rotational drive, and the results of the two edge position detectors 30 detecting the positions of the edge 91 of the printing paper 9 in the width direction. Then, the operation unit 200 may be configured to output the transport displacement Dc of the printing paper 9 in the transport direction through machine learning on the basis of those inputs.

In the above-described embodiment, the operation unit 200 uses, as teacher data (correct data), the actual transport displacement Dt of the printing paper 9 in the transport direction calculated by the image analyzer 201 and performs learning processing through machine learning so as to make it capable of highly accurately calculating the transport displacement Dc in the transport direction of the printing paper 9 transported by the transport mechanism 10 on the basis of the input continuous pulse signal En, the input tension signal Te, the input first and second edge signals Ed1 and Ed2, and the input information Sc. That is, the transport displacement Dc indicates the actual displacement of the printing paper 9 in the transport direction when the printing paper 9 is transported at the ideal transport speed. However, the operation unit 200 may perform learning processing through machine learning so as to make it capable of highly accurately calculating the difference between the ideal transport speed of the printing paper 9 and the actual transport speed, or the difference between the actual arrival time and an assumed arrival time at each of the recording heads 21 to 24 when the printing paper 9 is transported at the ideal speed.

In the above-described embodiment and variations, the operation unit 200 calculates the transport displacement Dc of the printing paper 9, and the ejection correction part 82 calculates the correction value for correcting either the ejection timing or position of ink droplets from each of the recording heads 21 to 24 on the basis of the calculation result of the transport displacement Dc. However, the operation unit 200 itself may calculate the correction value for correcting either the ejection timing or position of ink droplets from each of the recording heads 21 to 24 through machine learning and outputs the correction value to the print instruction part 83.

Figure 12:
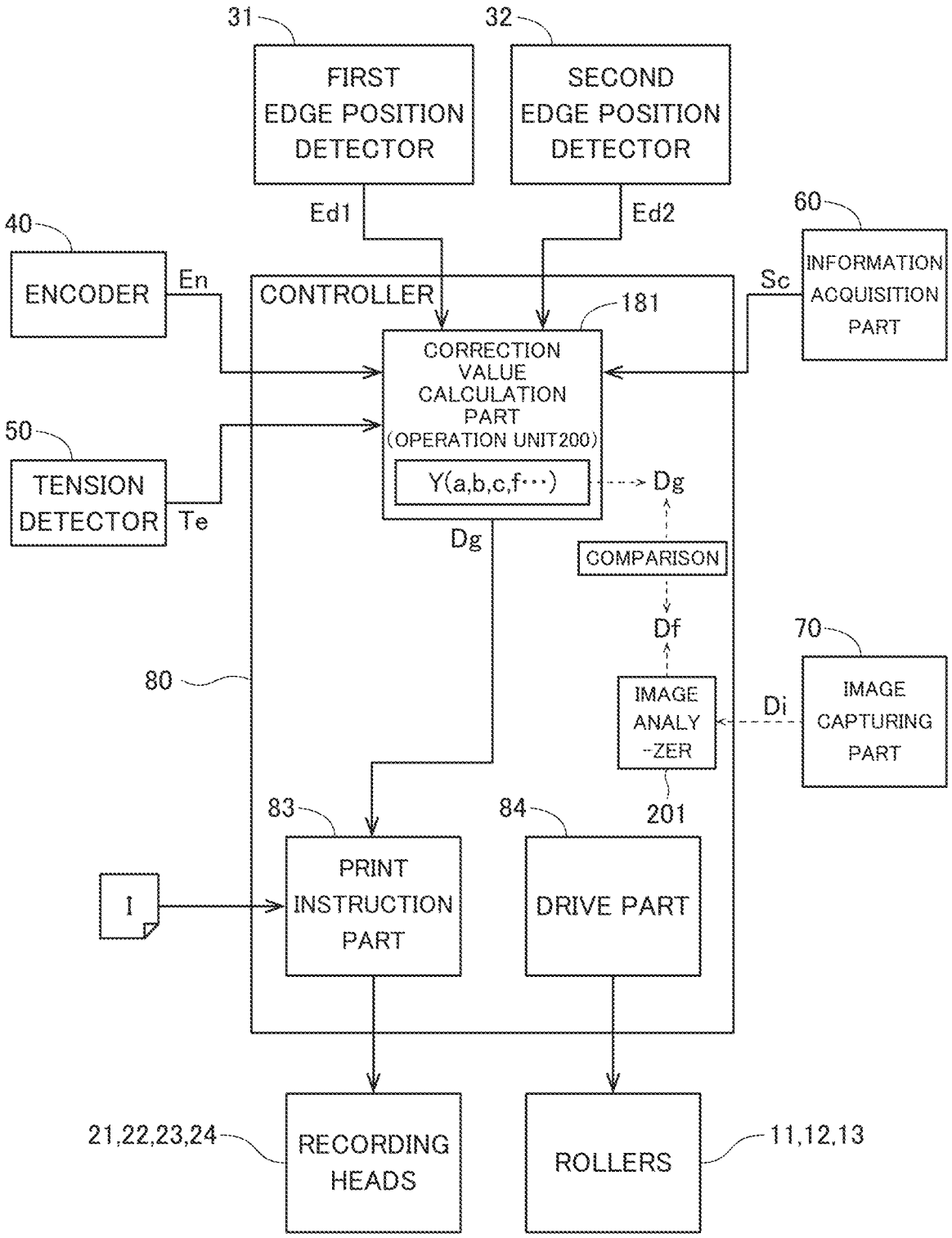
FIG. 12 is a block diagram schematically illustrating some functions implemented in a controller according to a variation.

FIG. 12 is a block diagram schematically illustrating some functions implemented in the controller 80 of the image recording apparatus 1 according to a variation. As illustrated in FIG. 12, the controller 80 according to this variation includes a correction value calculation part 181, the print instruction part 83, the drive part 84, and the image analyzer 201. The function of the correction value calculation part 181 is implemented by the operation unit 200 that includes some or all mechanical elements of the controller 80. The operation unit 200 stores a learned learning model generated through machine learning.

Figure 13:
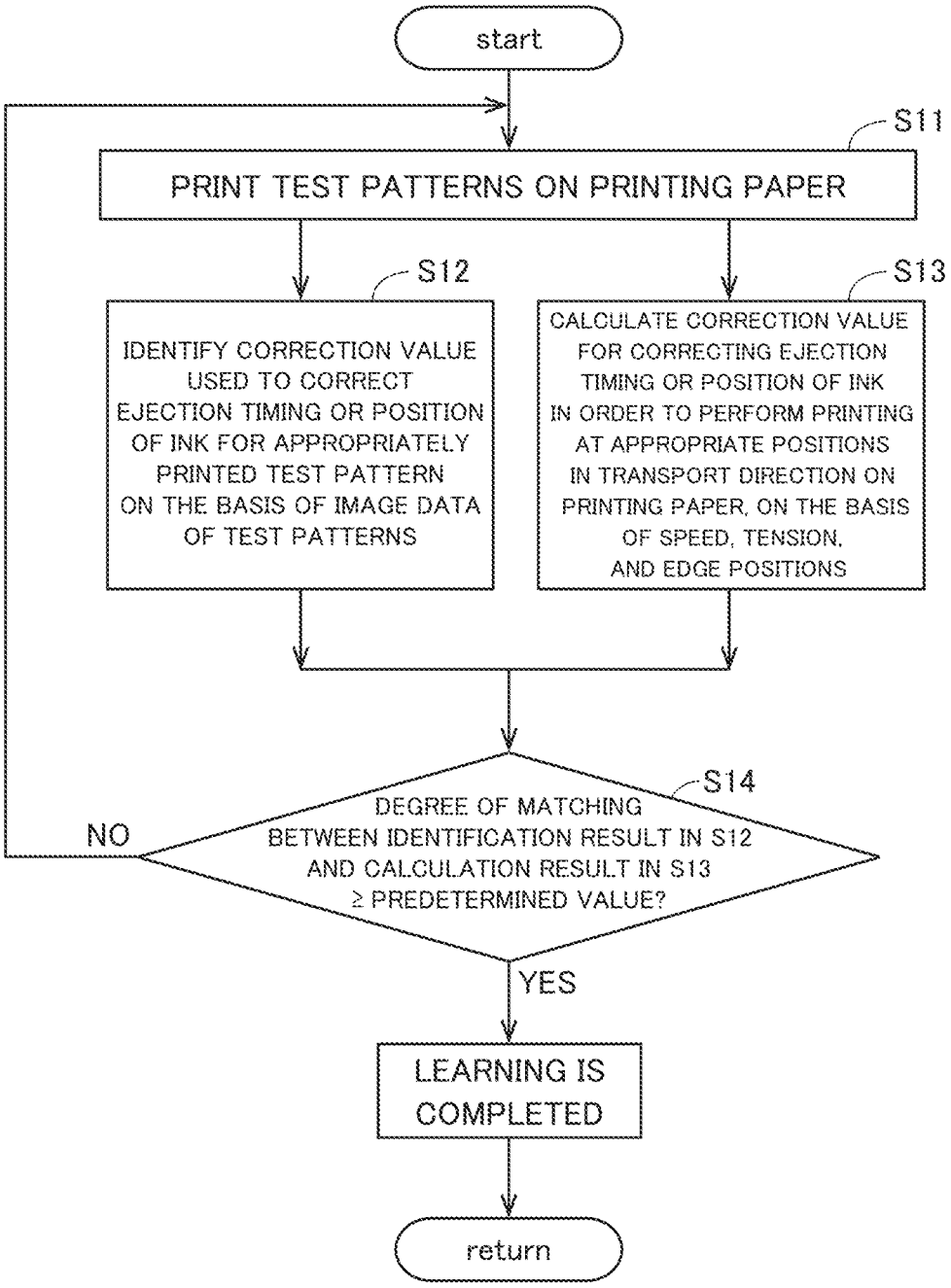
FIG. 13 is a flowchart illustrating a procedure of learning processing according to a variation.

FIG. 13 is a flowchart illustrating a procedure of learning processing according to the variation. As illustrated in FIG. 13, when learning is performed, first, a test pattern is printed on the surface of the printing paper 9 a plurality of times by practically ejecting ink from the recording heads 21 to 24 toward the printing paper 9 while transporting the printing paper 9 in the image recording apparatus 1 (step S11). Each test pattern as used herein refers to, for example, a plurality of lines or marks that are printed spaced from one another in the transport direction. In this variation, when a test pattern is printed a plurality of times, the ejection timing of ink droplets or the ejection position of ink droplets in the transport direction is corrected to various values for each printing. Then, the controller 80 stores the correction values used to correct the ejection timing or position of ink droplets for each printing.

The image capturing part 70 captures, a plurality of times, an image of the surfaces of a plurality of pieces of printing paper 9 on which the test patterns have been printed, so as to generate the image data Di. A plurality of pieces of image data Di is prepared as the image data for learning. For example, approximately 10 to 1000 pieces of image data are prepared for learning. These pieces of image data Di are input to the image analyzer 201. The image analyzer 201 analyzes each piece of image data Di, identifies a test pattern that is printed at an appropriate position in the transport direction on the printing paper 9 from among the plurality of test patterns, and identifies a correction value Df that is used to correct the ejection timing or position of ink when the test pattern has been printed (step S12).

Meanwhile, when the test patterns are printed on the printing paper 9, the encoder 40 detects a time-varying change in the amount of rotational drive of the transport roller 121 and inputs the continuous pulse signal En relating to the detection result to the operation unit 200. The tension detector 50 detects a time-varying change in the tension on the printing paper 9 that is in contact with the transport roller 122 and inputs the tension signal Te relating to the detection result to the operation unit 200. The first edge position detector 31 and the second edge position detector 32 intermittently detect the position in the width direction of the edge 91 of the printing paper 9 passing through the first detection position Pa and the second detection position Pb and input the first edge signal Ed1 and the second edge signal Ed2 relating to the detection results to the operation unit 200. As a pre-stage before the test patterns are printed on the printing paper 9, the information acquisition part 60 inputs to the operation unit 200 the information Sc relating to, for example, the type or amount of ink used for printing of the printing paper 9, environmental conditions including the temperature or humidity around the printing paper 9, and the type, shape, or thickness of the printing paper 9.

Then, the operation unit 200 performs learning processing through machine learning so as to make it capable of highly accurately calculating the correction value Dg for correcting the ejection timing or position of ink in order to perform printing at appropriate positions in the transport direction on the printing paper 9 transported by the transport mechanism 10, on the basis of the input continuous pulse signal En, the input tension signal Te, the input first and second edge signals Ed1 and Ed2, and the input information Sc (step S13). Specifically, the operation unit 200 uses, as teacher data (correct data), the aforementioned correction value Df for correcting the ejection timing or position of ink identified by the image analyzer 201 and performs machine learning of a learning model Y (a, b, c, f (En, Te, Ed1, Ed2), . . . ) that enables highly accurate calculation of the aforementioned correction value Dg for correcting the ejection timing or position of ink in order to perform printing at appropriate positions in the transport direction on the printing paper 90. Alternatively, instead of inputting the continuous pulse signal En indicating the time-varying change in the amount of rotational drive of the transport roller 121, the operation unit 200 may calculate a time-varying change in the amount of rotational drive of the transport roller 121 and use the calculation result in the machine learning. As another alternative, instead of inputting the tension signal Te indicating the time-varying change in the tension on the printing paper 9, the operation unit 200 may calculate a time-varying change in the tension on the printing paper 9 and use the calculation result in the machine learning.

As in the above-described embodiment, the learning model Y (a, b, c, f (En, Te, Ed1, Ed2), . . . ) stored in the operation unit 200 according to the variation is a decision tree. In the machine learning, the operation unit 200 adjusts, updates, and stores a plurality of parameters (a, b, c, f (En, Te, Ed1, Ed2), . . . ) included in the decision tree so as to minimize a difference between the correction value Df for correcting the appropriate ejection timing or position of ink identified by the image analyzer 201 and the correction value Dg for correcting the ejection timing or position of ink calculated on the basis of the input continuous pulse signal En, the input tension signal Te, the input first and second edge signals Ed1 and Ed2, and the input information Sc.

If the degree of matching between the correction value Dg for corroding the ejection timing or position of ink calculated by the operation unit 200 and the correction value Df for correcting the appropriate ejection timing or position of ink identified by the image analyzer 201 is greater than or equal to a predetermined value (step S14), the machine learning is completed. Accordingly, the image recording apparatus 1 becomes capable of calculating the correction value Dg for correcting the ejection timing or position of ink with high accuracy, with use of the learned learning model Y (a, b, c, f (En, Te, Ed1, Ed2), . . . ).

The above-described image recording apparatus 1 is configured to record a multicolor image on the printing paper 9 by inkjet printing. However, the base material processing apparatus according to the present invention may be an apparatus that uses a different method other inkjet printing to record a multicolor image on the printing paper. For example, the base material processing apparatus may use, for example, electrophotography or exposure to record a multicolor image on the printing paper 9. The above-described image recording apparatus 1 is configured to perform print processing on the printing paper 9 that is a base material. However, the base material processing apparatus according to the present invention may be configured to perform predetermined processing on a long band-like base material other than the ordinary paper. For example, the base material processing apparatus may perform predetermined processing on materials such as a resin film or metal leaf.

The base material processing apparatus according to the present invention includes a transport mechanism that transports a long band-like base material in a longitudinal direction of the base material along a transport path formed by a plurality of rollers, a transport displacement calculation part that calculates a transport displacement in a transport direction of the base material that is being transported, and at least one of a) a tension detector connected directly or indirectly to at least one of the plurality of rollers and that detects tension on the base material that is being transported by the plurality of rollers, b) an encoder connected directly or indirectly to at least one of the plurality of rollers and that detects an amount of rotational drive of the at least one roller; and c) an edge position detector that continuously or intermittently detects a position of an edge of the base material in a width direction at each of a first detection position and a second detection position that are spaced from each other in the transport direction in the transport path. The transport displacement calculation part may include an operation unit that has completed learning through machine learning and outputs a transport displacement of the base material in the transport direction on the basis of input of at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction. Accordingly, the transport displacement of the base material in the transport direction can be detected with high accuracy and low cost even in cases such as where the base material is transported at high speeds or where the edge of the printing paper has fine irregularities smaller than the interval of measurements by the sensors.

In particular, the base material processing apparatus calculates the transport displacement of the base material in the transport direction by using either the result of the tension detector detecting the tension on the base material or the result of calculating the amount of change in the tension. The tension detector is a facility that has already been introduced in many cases. Therefore, a further cost reduction is possible.

Similarly, the base material processing apparatus calculates the transport displacement of the base material in the transport direction by using either the result of the encoder detecting the amounts of rotational drive of the rollers or the result of calculating the amount of change in the amounts of rotational drive. The encoder is a facility that has already been introduced in many cases. Therefore, a further cost reduction is possible.

The base material processing apparatus calculates the transport displacement of the base material in the transport direction by using the result of the edge position detector detecting the position of the edge of the base material in the width direction. Accordingly, the transport displacement of the base material in the transport direction can be detected with high accuracy and low cost even in cases where the tension on the base material is excessively low or where the transport speed of the base material is excessively low.

The base material processing apparatus may further include an information acquisition part that acquires information relating to at least one of a type of the base material, a thickness of the base material, and an environmental condition including temperature or humidity around the base material. The operation unit may be configured to output the transport displacement of the base material in the transport direction on the basis of input of the information acquired by the information acquisition part and at least one of either the result of the tension detector detecting the tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction. Accordingly, the transport displacement of the base material in the transport direction can be detected with higher accuracy.

The base material processing apparatus may further include an image recording part that ejects ink to a surface of the base material at a processing position in the transport path to record an image, and an information acquisition part that acquires information relating to a type or amount of the ink ejected from the image recording part. The operation unit may be configured to output the transport displacement of the base material in the transport direction on the basis of input of the information acquired by the information acquisition part and at least one of either the result of the tension detector detecting the tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction. Accordingly, the transport displacement of the base material in the transport direction can be detected with higher accuracy.

A base material processing method according to the present invention is a base material processing method for calculating a transport displacement of a long band-like base material in a transport direction while transporting the base material in a longitudinal direction of the base material along a transport path formed by a plurality of rollers. The method includes at least one of a) detecting tension on the base material that is being transported by the plurality of rollers, b) detecting amounts of rotational drive of the plurality of rollers, and c) continuously or intermittently detecting a position of an edge of the base material in a width direction at each of a first detection position and a second detection position that are spaced from each other in the transport direction in the transport path, and d) calculating a transport displacement of the base material in the transport direction. Before the operation d), machine learning may be performed so as to make it capable of outputting the transport displacement of the base material in the transport direction with high accuracy on the basis of input of at least one of either a result of detecting the tension on the base material in the operation a) or a result of calculating an amount of change in the tension, either a result of detecting the amounts of rotational drive of the plurality of rollers in the operation b) or a result of calculating an amount of change in the amounts of rotational drive, and a result of detecting the position of the edge of the base material in the width direction in the operation c).

Moreover, the controller of the base material processing apparatus may have a function serving as an expansion-contraction error calculation part that calculates an expansion-contraction error in the width direction of the base material that is being transported, through machine learning. Specifically, the expansion-contraction error calculation part may include a second operation unit that has completed learning through machine learning and outputs an expansion-contraction error in the width direction of the base material at the processing position on the basis of input of the information acquired by the information acquisition part and at least one of either the result of the tension detector detecting tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction. It is desirable that the information acquired by the information acquisition part may include, in particular, information relating to the type or amount of ink, which is an element that is likely to affect the expansion/contraction of the base material in the width direction. The base material processing apparatus may further have a function of correcting conditions such as meandering, a change in obliqueness, travelling position, and a change in dimension in the width direction, on the basis of the calculated expansion-contraction error of the base material in the width direction.

The base material processing apparatus according to the present invention includes a transport mechanism that transports a long band-like base material in a longitudinal direction of the base material along a transport path formed by a plurality of rollers, an image recording part that ejects ink to a surface of the base material at a processing position in the transport path to record an image, a correction value calculation part that calculates a correction value for correcting an ejection timing or position of the ink and outputs the correction value to the image recording part, and at least one of a) a tension detector connected directly or indirectly to at least one of the plurality of rollers and that detects tension on the base material that is transported by the plurality of rollers, b) an encoder connected directly or indirectly to at least one of the plurality of rollers and that detects the amounts of rotational drive of the rollers, and c) an edge position detector that continuously or intermittently detects a position of an edge of the base material in a width direction at each of a first detection position and a second detection position that are spaced from each other in the transport direction in the transport path. The correction value calculation part may include an operation unit that has completed learning through machine learning and outputs a correction value for correcting an ejection timing or position of the ink on the basis of input of at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction. Accordingly, the ink can be ejected at appropriate positions in the transport direction on the base material with high accuracy and low cost even in cases such as where the base material is transported at high speeds or where the edge of the printing paper has fine irregularities smaller than the interval of measurements by the sensors.

Each element used in the above-described embodiments and variations may be appropriately combined within a range that presents no contradictions.

While the invention has been shown and described in detail, the foregoing description is in all aspects illustrative and not restrictive. It is therefore to be understood that numerous modifications and variations can be devised without departing from the scope of the invention.

What is claimed is:

1. A base material processing apparatus comprising:

a transport mechanism that transports a long band-like base material in a longitudinal direction of the base material along a transport path formed by a plurality of rollers;

an image recording part that ejects ink to a surface of the base material at a processing position in the transport path to record an image;

an image capturing part that generates image data of the base material by capturing an image of a surface of the base material on which the image recording part has ejected the ink;

a transport displacement calculation part that calculates a transport displacement in a transport direction of the base material that is being transported, the transport displacement calculation part including an operation unit; and at least one of:

a) a tension detector connected directly or indirectly to at least one of the plurality of rollers and that detects tension on the base material that is being transported by the plurality of rollers;

b) an encoder connected directly or indirectly to at least one of the plurality of rollers and that detects an amount of rotational drive of the at least one roller; and c) an edge position detector that continuously or intermittently detects a position of an edge of the base material in a width direction at each of a first detection position and a second detection position that are spaced from each other in the transport direction in the transport path, wherein the operation unit has learned learning model generated through machine learning, the operation unit outputting, a transport displacement of the base material in the transport direction on the basis of input of at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction, and wherein in the machine learning, the operation unit uses an actual transport displacement, acquired by input from an image analyzer calculating the actual transport displacement of the base material in the transport direction through image analysis on the basis of the image data of the base material or calculated through a visual check by an operator or other person on the basis of the image data, as teacher data, and adjusts a plurality of parameters included in the learning model so as to minimize a difference between the teacher data and the transport displacement outputted by the learning model.

2. The base material processing apparatus according to claim 1, further comprising:

an information acquisition part that acquires information relating to at least one of a type of the base material, a thickness of the base material, and an environmental condition including temperature or humidity around the base material, wherein the operation unit outputs the transport displacement of the base material in the transport direction on the basis of input of the information acquired by the information acquisition part and at least one of either the result of the tension detector detecting the tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction.

3. The base material processing apparatus according to claim 1, further comprising:

an information acquisition part that acquires information relating to a type or amount of the ink ejected from the image recording part, wherein the operation unit outputs the transport displacement of the base material in the transport direction on the basis of input of the information acquired by the information acquisition part and at least one of either the result of the tension detector detecting the tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction.

4. The base material processing apparatus according to claim 3, further comprising:

an expansion-contraction error calculation part that calculates an expansion-contraction error in the width direction of the base material that is being transported, the expansion-contraction error calculation part including a second operation unit that has completed learning through machine learning and outputs an expansion-contraction error in the width direction of the base material at the processing position on the basis of input of the information acquired by the information acquisition part and at least one of either the result of the tension detector detecting tension on the base material or the result of calculating the amount of change in the tension, either the result of the encoder detecting the amount of rotational drive of the roller or the result of calculating the amount of change in the amount of rotational drive, and the result of the edge position detector detecting the position of the edge of the base material in the width direction.

5. The base material processing apparatus according to claim 1, further comprising an ejection correction part that calculates a correction value for correcting an ejection timing or position of the ink from the image recording part on the basis of the transport displacement of the base material in the transport direction calculated by the transport displacement calculation part.

6. The base material processing apparatus according to claim 1, wherein the image recording part includes a plurality of recording heads aligned in the transport direction, and the plurality of recording heads eject ink of different colors.

7. The base material processing apparatus according to claim 1, wherein the operation unit includes a decision tree, and wherein the plurality of parameters adjusted through the machine learning are the parameters included in the decision tree.

8. A base material processing method for calculating a transport displacement of a long band-like base material in a transport direction while transporting the base material in a longitudinal direction of the base material along a transport path formed by a plurality of rollers, the method comprising:

at least one of:

a) detecting tension on the base material that is being transported by the plurality of rollers;

b) detecting amounts of rotational drive of the plurality of rollers; and c) continuously or intermittently detecting a position of an edge of the base material in a width direction at each of a first detection position and a second detection position that are spaced from each other in the transport direction in the transport path;

d) ejecting ink to a surface of the base material while transporting the base material;

e) generating image data of the base material by capturing an image of the surface of the base material on which the ink is ejected; and f) calculating a transport displacement of the base material in the transport direction, wherein learning model has been learned and generated through machine learning, before the operation f) to make it capable of outputting the transport displacement of the base material in the transport direction with high accuracy on the basis of input of at least one of either a result of detecting the tension on the base material in the operation a) or a result of calculating an amount of change in the tension, either a result of detecting the amounts of rotational drive of the plurality of rollers in the operation b) or a result of calculating an amount of change in the amounts of rotational drive, and a result of detecting the position of the edge of the base material in the width direction in the operation c), and wherein in the machine learning, an actual transport displacement of the base material in the transport direction, acquired by calculating through image analysis on the basis of the image data generated in the operation e) of the base material or by calculating through a visual check by an operator or other person on the basis of the image data, is used as teacher data, and a plurality of parameters included in the learning model are adjusted so as to minimize a difference between the teacher data and the calculated transport displacement in the operation f).

9. The base material processing method according to claim 8, further comprising:

g) acquiring information relating to at least one of a type of the base material, a thickness of the base material, and an environmental condition including temperature or humidity around the base material, wherein the machine learning is performed before the operation f) to make it capable of outputting the transport displacement of the base material in the transport direction with high accuracy on the basis of the information acquired in the operation g) and at least one of either the result of detecting the tension on the base material in the operation a) or the result of calculating the amount of change in the tension, either the result of detecting the amounts of rotational drive of the plurality of rollers in the operation b) or the result of calculating the amount of change in the amounts of rotational drive, and the result of detecting the position of the edge of the base material in the width direction in the operation c).

10. The base material processing method according to claim 8, further comprising:

g) acquiring information relating to a type or amount of the ink ejected in the operation d), wherein the machine learning is performed before the operation f) to make it capable of outputting the transport displacement of the base material in the transport direction with high accuracy on the basis of the information acquired in the operation g) and at least one of either the result of detecting the tension on the base material in the operation a) or the result of calculating the amount of change in the tension, either the result of detecting the amounts of rotational drive of the plurality of rollers in the operation b) or the result of calculating the amount of change in the amounts of rotational drive, and the result of detecting the position of the edge of the base material in the width direction in the operation c).

11. The base material processing method according to claim 10, further comprising:

h) calculating a correction value for correcting an ejection timing or position of the ink in the operation f) on the basis of the transport displacement of the base material in the transport direction calculated in the operation f).

12. A base material processing apparatus comprising:

a transport mechanism that transports a long band-like base material in a longitudinal direction of the base material along a transport path formed by a plurality of rollers;

an image recording part that ejects ink to a surface of the base material at a processing position in the transport path to record an image;

an image capturing part that generates image data of the base material by capturing an image of a surface of the base material on which the image recording part has ejected the ink;

a transport displacement calculation part that calculates a transport displacement in a transport direction of the base material that is being transported;

an image analyzer that calculates a transport displacement of the base material in the transport direction through image analysis on the basis of the image data, an information acquisition part that acquires information relating to a type or amount of the ink ejected from the image recording part, and at least one of:

a) a tension detector connected directly or indirectly to at least one of the plurality of rollers and that detects tension on the base material that is being transported by the plurality of rollers;

b) an encoder connected directly or indirectly to at least one of the plurality of rollers and that detects an amount of rotational drive of the at least one roller; and c) an edge position detector that continuously or intermittently detects a position of an edge of the base material in a width direction at each of a first detection position and a second detection position that are spaced from each other in the transport direction in the transport path, wherein the transport displacement calculation part includes an operation unit that has completed learning through machine learning and outputs a transport displacement of the base material in the transport direction on the basis of input of the information acquired by the information acquisition part and at least one of either a result of the tension detector detecting the tension on the base material or a result of calculating an amount of change in the tension, either a result of the encoder detecting the amount of rotational drive of the at least one roller or a result of calculating an amount of change in the amount of rotational drive, and a result of the edge position detector detecting the position of the edge of the base material in the width direction, and wherein the operation unit has completed the machine learning, using, as teacher data, a result of the image analyzer calculating the transport displacement of the base material in the transport direction.

* * * * *